US007147439B2

(12) United States Patent
Jacala et al.

(10) Patent No.: US 7,147,439 B2
(45) Date of Patent: Dec. 12, 2006

(54) APPARATUS AND METHODS FOR COOLING TURBINE BUCKET PLATFORMS

(75) Inventors: Ariel Caesar Jacala, Simpsonville, SC (US); Gary M. Itzel, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 139 days.

(21) Appl. No.: 10/940,716

(22) Filed: Sep. 15, 2004

(65) Prior Publication Data

US 2006/0056970 A1 Mar. 16, 2006

(51) Int. Cl.
*F01D 5/18* (2006.01)

(52) U.S. Cl. ..... 416/97 R; 416/193 A

(58) Field of Classification Search ..... 416/96 R, 416/97 R, 193 A; 415/115
See application file for complete search history.

(56) References Cited

U.S. PATENT DOCUMENTS 5,350,277 A 9/1994 Jacala et al.
5,536,143 A 7/1996 Jacala et al.
5,593,274 A 1/1997 Carreno et al.
6,019,579 A * 2/2000 Fukuno et al. ..... 416/97 R
6,092,983 A * 7/2000 Tomita et al. ..... 415/115
6,132,173 A * 10/2000 Tomita et al. ..... 416/96 R
6,390,774 B1 * 5/2002 Lewis et al. ..... 416/96 R
6,422,817 B1 7/2002 Jacala

* cited by examiner

*Primary Examiner*—Ninh H. Nguyen
(74) *Attorney, Agent, or Firm*—Nixon & Vanderhye P.C.

(57) ABSTRACT

A bucket has an airfoil, a root and a platform between the root and airfoil. The airfoil includes a serpentine cooling circuit, and the platform includes plural cavities, one or more cavities each having a serpentine cooling circuit. Cooling medium is drawn from one of the passages of the airfoil cooling circuit for flow in the platform cooling circuit and for return either to another passage of the airfoil circuit or to a trailing edge exit. The platform cooling circuits thus convectively cool both high and low pressure sides of the platform.

19 Claims, 3 Drawing Sheets

APPARATUS AND METHODS FOR COOLING TURBINE BUCKET PLATFORMS

BACKGROUND OF THE INVENTION

The present invention relates to buckets for turbines and particularly relates to a cooling system for cooling the platforms interfacing between the bucket airfoils and bucket roots.

Over the years, gas turbines have trended towards increased inlet firing temperatures to improve output and engine efficiencies. As gas path temperatures have increased, bucket platforms have increasingly exhibited distress including oxidation, creep and low cycle fatigue cracking. With the advent of closed circuit steam cooling, e.g., in the first two stages of buckets and nozzles in industrial gas turbines, inlet profiles have become such that the platforms are exposed to temperatures close to peak inlet temperatures for the blade row. This exacerbates the potential distress on bucket platforms as they run hotter.

Many older bucket designs did not require active cooling of the platforms due to lower firing temperatures. Also, film cooling carryover from upstream nozzle side walls tended to lower the temperatures near the platforms from the resulting "pitch line bias" of the inlet temperature profile. Certain designs have utilized film cooling by drilling holes through the platform and using compressor discharge air to provide a layer of cooler insulating film on the platform surface, protecting it from the high gas flow path temperatures. This is limited to areas where there is sufficient pressure to inject the film, and many current designs have insufficient pressure to film cool the entirety of the platform. Consequently, there is a need for a cooling system which will reduce the platform temperature to a level required to meet part-life or durability requirements including oxidation, creep and low cycle fatigue cracking in steam or air-cooled buckets for gas turbines.

BRIEF DESCRIPTION OF THE INVENTION

In a preferred aspect of the present invention, there is provided a bucket having an airfoil, a root, and a platform at an interface between the airfoil and the root, the airfoil having a cooling circuit including a plurality of passages for receiving a cooling medium and flowing the cooling medium along the airfoil to cool the airfoil, the platform having a cooling circuit including a cavity along an underside thereof. The cavity has an inlet lying in communication with one of the passages for extracting at least a portion of the cooling medium from the one passage and flowing the extracted cooling medium portion within the platform cooling circuit of the cavity to cool the platform, the cavity having an outlet lying in communication with another cooling passage of the airfoil.

In another preferred aspect of the present invention, there is provided a bucket having an airfoil, a root, and a platform at an interface between the airfoil and the root, said airfoil having a cooling circuit including a plurality of generally radial passages for receiving a cooling medium and flowing the cooling medium along the airfoil to cool the airfoil, a method of cooling the platform comprising the steps of providing a cavity within or along an underside of the platform; extracting at least a portion of the cooling medium from one of said airfoil cooling passages; flowing the extracted cooling medium portion within the platform; and cooling circuit of the cavity to convectively cool the platform, and flowing spent cooling medium from said cavity through an outlet in communication with another cooling passage of the airfoil.

DETAILED DESCRIPTION OF THE INVENTION

Figure 1:
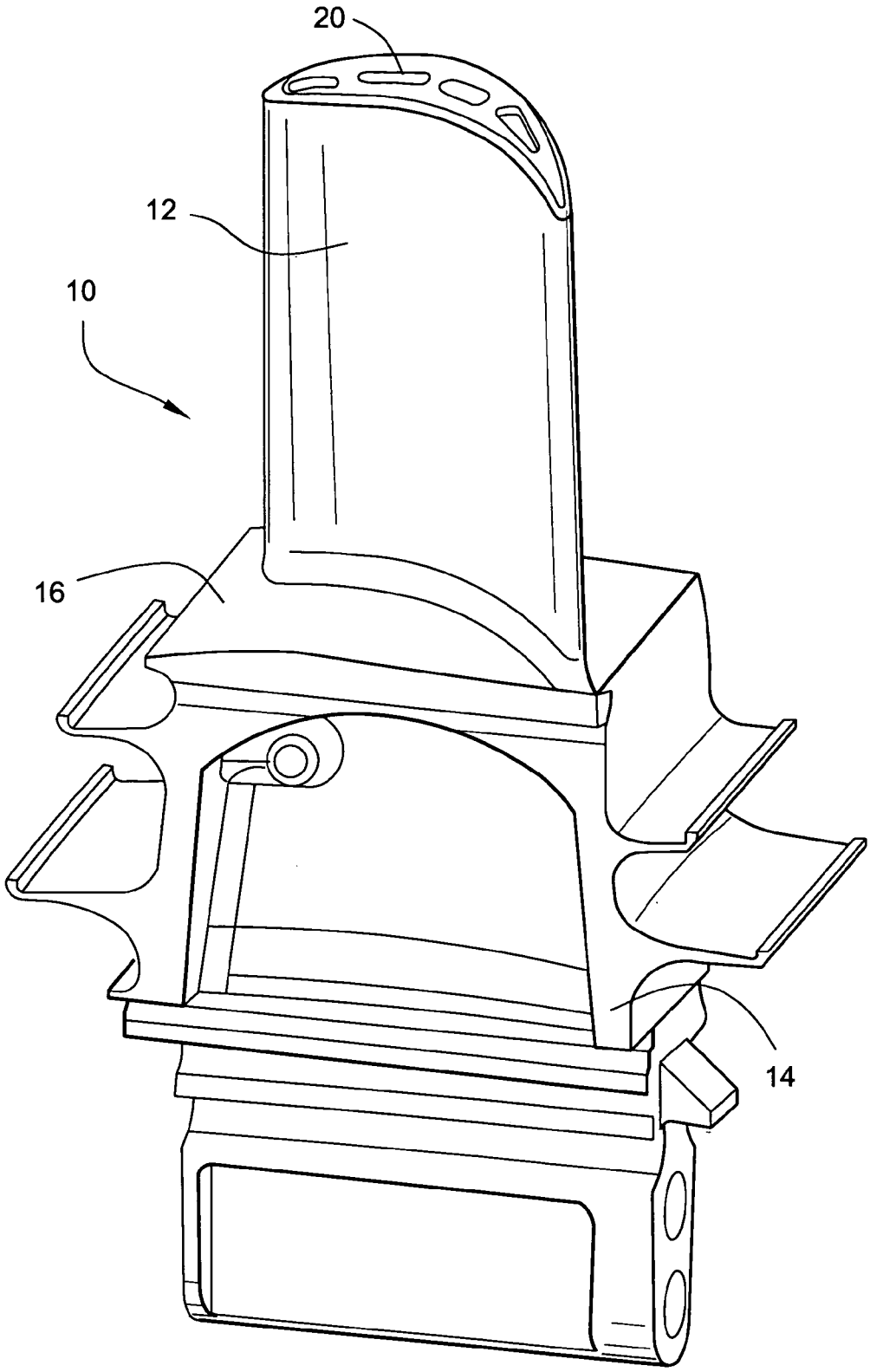
FIG. 1 is a perspective view of a bucket for a turbine incorporating a platform cooling system according to a preferred aspect of the present invention.
Figure 2:
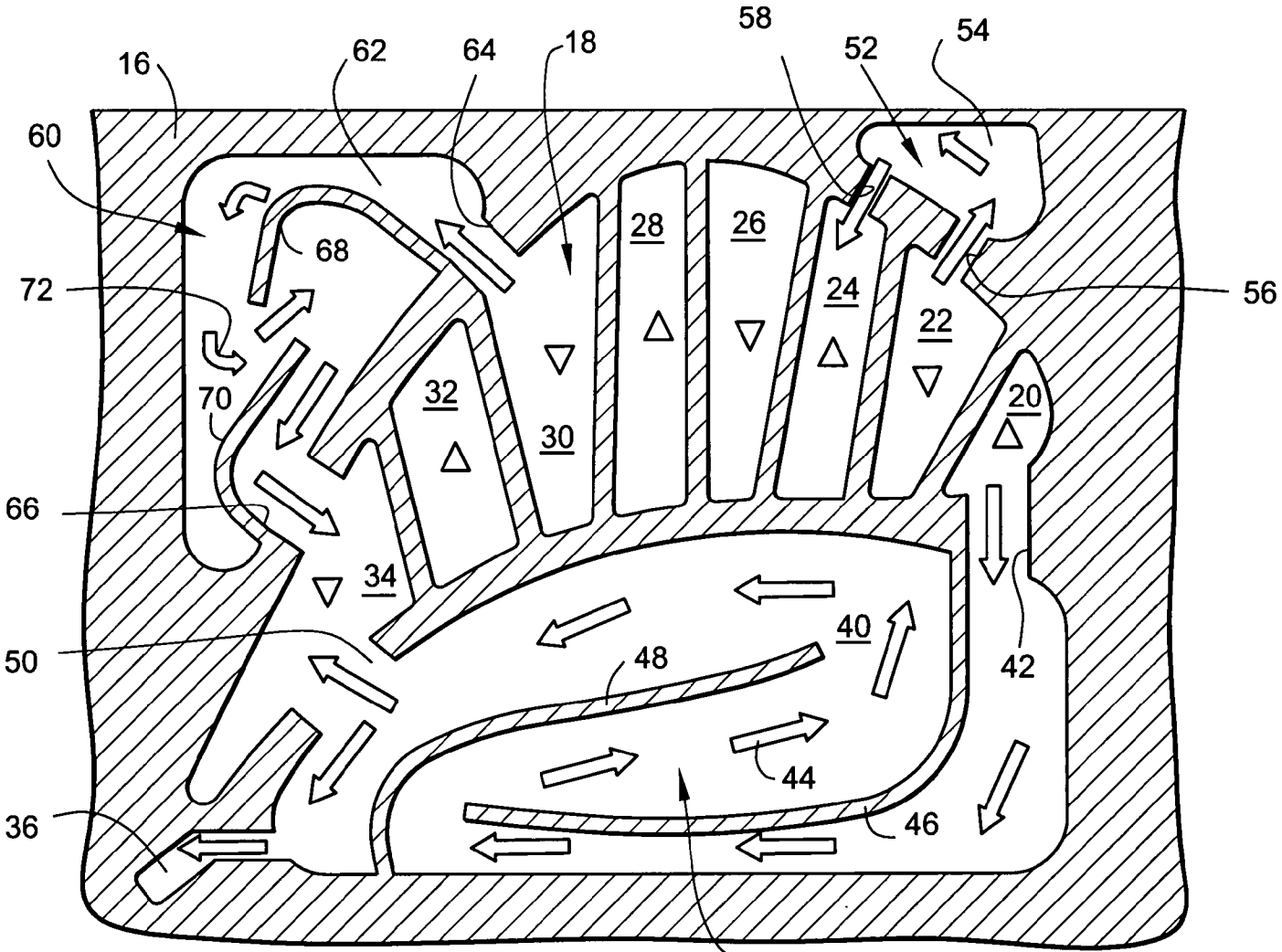
FIG. 2 is a cross sectional view through the platform as viewed in a direction generally radially outwardly of the bucket illustrating an example of the platform cooling system hereof.

Referring now to the drawing figures, particularly to FIG. 1, there is illustrated a bucket generally designated 10 for a gas turbine including an airfoil 12 and a bucket root 14. A bucket platform 16 lies at an interface between the airfoil 12 and root 14. The airfoil 12 has a cooling circuit generally designated 18 in FIG. 2 including a plurality of generally radial passages for receiving a cooling medium and flowing the cooling medium along the airfoil 12 to cool the airfoil. It will be appreciated that the cooling medium may constitute steam or air and that any number of cooling passages may be arranged within the airfoil 12. For example, as illustrated in FIG. 2, there are provided eight passages which form the airfoil cooling circuit. The passages may be in the form of a closed circuit, for example, for steam cooling, similarly as set forth in U.S. Pat. No. 5,536,143 of common assignee herewith, or the passages may comprise open circuits with one or more of the passages terminating in exit holes at the tip of the airfoil, e.g., the exit holes 20 illustrated in FIG. 1. Preferably, the cooling circuit within the airfoil is generally serpentine-shaped.

Referring to FIG. 2, the airfoil cooling circuit 18 includes generally radial passages 20, 22, 24, 26, 28, 30, 32 and 34. In the illustration of FIG. 2, the right side up triangles in passages 20, 24, 28 and 32 indicate a generally radial outward flow of the cooling medium while the upside-down triangles in passages 22, 26, 30 and 34 indicate a generally radial inward flow of the cooling medium. In a serpentine flow path for the cooling medium, e.g. closed circuit steam cooling, the cooling medium enters the leading edge passage 20 and alternately flows radially outwardly and radially inwardly through the various airfoil passages ultimately for return through a trailing edge passage 34 for dumping the cooling medium into a cooling medium exit 36.

Again referring to FIG. 2, the platform 16 of each bucket includes at least one cavity formed along an underside thereof or within the platform and includes a cooling circuit for cooling the platform. Preferably three cavities are provided each platform, each cavity having a cooling circuit for cooling the platform. The first cooling platform circuit 38 includes a cavity 40. In circuit 38, the cooling medium is extracted from an inlet to the first radial outward passage 20 of the airfoil 12. Thus, the cooling medium inlet 42 for the first cooling circuit supplies cooling air to generally serpentine-shaped cooling passages indicated by the arrows 44 in FIG. 2. The cavity 40 lies generally within the platform 16 and inner wall portions 46 and 48 define with the outer walls of the cavity the generally serpentine shape of the cooling passage. Where steam is the cooling medium, e.g. the serpentine cooling passage 44 also has an outlet 50 for dumping a portion of the steam into the trailing edge cooling passage 34. The trailing edge passage 34 and the exit 36 combine within the root of the airfoil to return the spent cooling steam, for example, to a heat recovery steam generator, not shown. From a review of FIG. 2, it will be appreciated that the cooling circuit 38 in cavity 40 of the platform 16 convectively cools the low pressure side of the platform, i.e., the side of the platform underlying the pressure side of the airfoil.

A second platform cooling circuit 52 includes a second cavity 54 formed in or along the underside of the platform 16. The second cavity 54 includes an inlet 56 in communication with the cooling medium flowing in the radial inward or second cooling passage 22 of the airfoil 12 and an outlet 58 in communication with the cooling medium flowing radially outwardly in the third airfoil cooling passage 24. The extracted cooling medium from passage 22 into cavity 54 convectively cools a portion of the high pressure side of the platform 16 as the coolant traverses the second platform cooling circuit and then dumps the cooling medium into the third passage 24.

A third platform circuit generally designated 60 includes a cavity 62 formed in or along the underside of the platform 16. The third cavity 62 includes an inlet 64 in communication with the cooling medium flowing radially inwardly in the sixth passage 30 of the airfoil 12. Cavity 62 also includes an outlet 66 in communication with the cooling medium flowing radially inwardly along the trailing edge passage 34 of airfoil 12. Cavity 62 further includes walls 68 and 70 which define with the outer walls of the cavity a serpentine cooling flow designated 72 within the third cooling platform circuit. Thus, the third cooling platform circuit convectively cools a portion of the high pressure side of the platform adjacent the suction side of the airfoil. Consequently, by combining at least two and preferably all three platform cooling circuits, both the low pressure and high pressure sides of the platform are convectively cooled by the cooling medium. It will be appreciated that the bucket may employ one, two or all three of the cooling circuits as desired.

Figure 3:
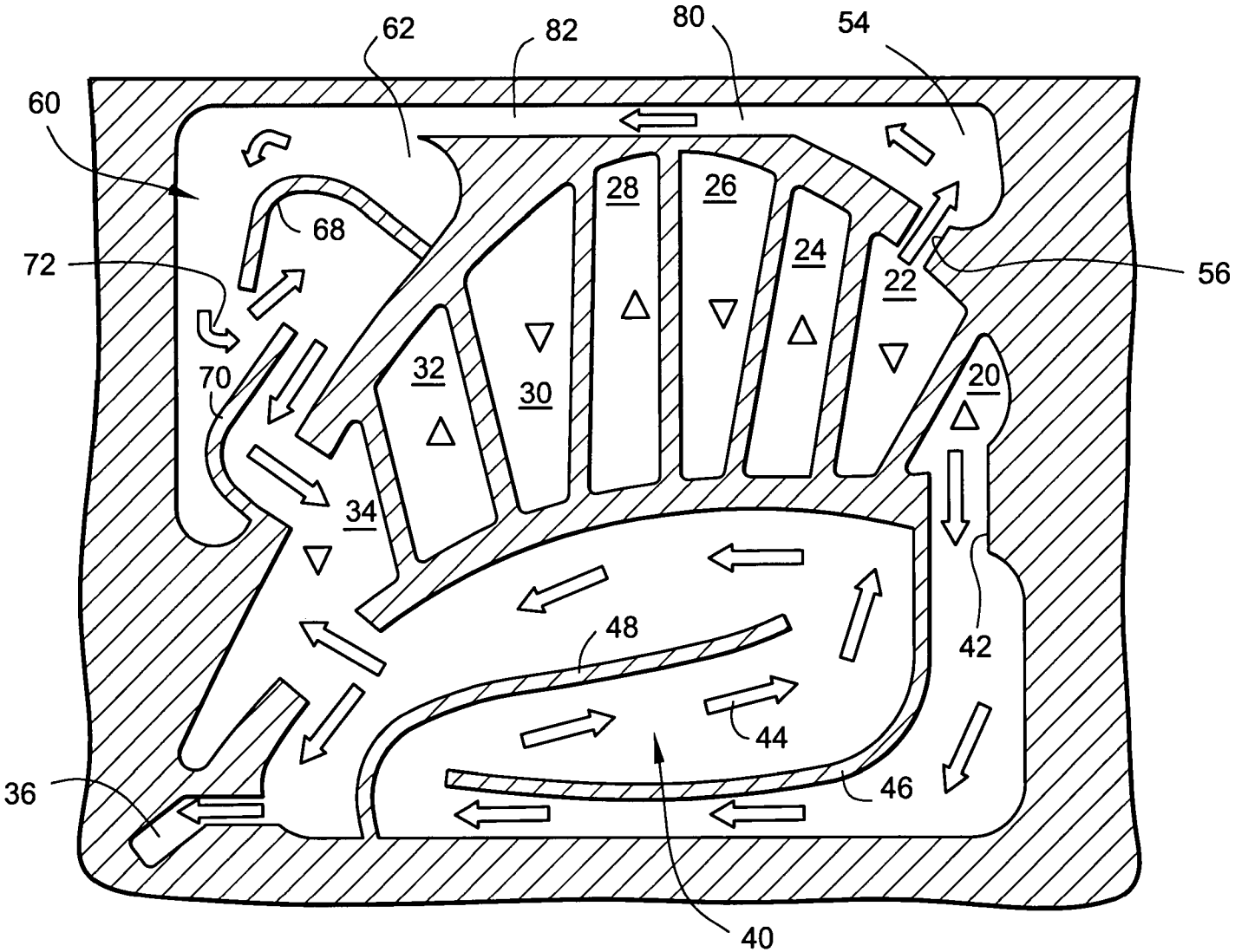
FIG. 3 is a view similar to FIG. 2 showing a further aspect of the present invention.

Referring now to FIG. 3, there is illustrated another example of a platform cooling circuit according to an aspect of the present invention. In this aspect, the first cooling circuit in the first cavity 40 remains the same and like reference numerals are applied to like parts. Similarly, the second cavity 54 of FIG. 3 is similar to the cavity 52 of FIG. 2, like reference numerals being applied to like parts, except that the outlet from the second platform cooling circuit exits directly and supplies the cooling medium to the third cooling circuit 60 without traversing any of the airfoil cooling circuit passages. Particularly, the second cavity 54 of the embodiment depicted in FIG. 3 includes an outlet 80 which communicates directly with the third cavity 62, the outlet 80 serving as the inlet 82 to cavity 62. Like reference numerals are applied to like parts in the third cavity as in the embodiment of FIG. 2, and the remaining portions of the platform cooling circuit are identical to those described and illustrated in FIG. 2.

The passages in the platform may be formed by using ceramic cores or by forming them in wax in a lost wax, i.e., investment casting process. In the latter method, a plate, not shown, joined by welding or brazing to the bucket totally encloses the passages to form the cooling circuits. It will be appreciated that the circuit configurations are not limited to the examples illustrated in FIGS. 2 and 3. For example, the cooling medium may be extracted from any passage of the main airfoil serpentine passages and dumped to any passage of the main airfoil serpentine cooling circuit provided there is sufficient pressure in the circuit from inlet to exit to enable a sufficiently high rate of heat transfer in the passage.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A bucket having an airfoil, a root, and a platform at an interface between the airfoil and the root, said airfoil having a cooling circuit including a plurality of generally radial passages for receiving a cooling medium and flowing the cooling medium along the airfoil to cool the airfoil, said platform having a cooling circuit including a cavity within or along an underside thereof, said cavity having an inlet lying in communication with one of the passages for extracting at least a portion of the cooling medium from said one passage and flowing the extracted cooling medium portion within the platform cooling circuit of the cavity convectively to cool the platform, said cavity having an outlet lying in communication with another cooling passage of the airfoil:

wherein said platform cooling circuit includes a generally serpentine-shaped flow passage defined by inner and outer walls of said cavity.

2. A bucket according to claim 1 wherein said another passage forms part of a trailing edge cooling passage.

3. A bucket according to claim 1 wherein said plurality of passages of said airfoil cooling circuit forming a generally serpentine-shaped airfoil cooling circuit with said one passage thereof for flowing the cooling medium generally radially outwardly along the airfoil and a further passage for flowing the cooling medium generally radially inwardly, said inlet of said cavity lying in communication with said one passage.

4. A bucket according to claim 3 wherein said outlet from said cavity lies in communication with said further passage.

5. A bucket according to claim 1 wherein said cavity lies along a low pressure side of the platform.

6. A bucket according to claim 1 wherein said cavity lies along a high pressure side of said platform.

7. A bucket having an airfoil, a root, and a platform at an interface between the airfoil and the root, said airfoil having a cooling circuit including a plurality of generally radial passages for receiving a cooling medium and flowing the cooling medium along the airfoil to cool the airfoil, said platform having a cooling circuit including a first cavity within or along an underside thereof, said first cavity having an inlet lying in communication with one of the passages for extracting at least a portion of the cooling medium from said one passage and flowing the extracted cooling medium portion within the platform cooling circuit of the first cavity convectively to cool the platform, said first cavity having an outlet lying in communication with another cooling passage of the airfoil:

wherein said platform includes a second cavity within or along an underside thereof, said second cavity having an inlet in communication with a second of said passages for extracting at least a portion of the cooling medium from said second passage and flowing the extracted cooling medium portion within the second cavity of the platform cooling circuit to convectively cool the platform, said second cavity having an outlet lying in communication with a further passage of the airfoil cooling passages.

8. A bucket according to claim 7 wherein said platform cooling circuit includes generally serpentine-shaped flow passages within the first and second cavities, respectively.

9. A bucket according to claim 7 wherein said first and second cavities lie on respective low and high pressure sides of said platform.

10. A bucket according to claim 7 wherein said platform includes a third cavity within or along an underside thereof, said third cavity having an inlet in communication with a third of said passages for extracting at least a portion of the cooling medium from said third passage and flowing the extracted cooling medium portion within the third cavity of the platform to convectively cool the platform, said third cavity having an outlet lying in communication with a still further passage of the airfoil cooling passages.

11. A bucket according to claim 10 wherein said platform cooling circuit includes generally serpentine-shaped flow passages within at least the first, and third cavities, respectively.

12. A bucket according to claim 11 wherein said first, second and third cavities lie on respective low, high and high pressure sides of said platform.

13. In a bucket having an airfoil, a root, and a platform at an interface between the airfoil and the root, said airfoil having a cooling circuit including a plurality of generally radial passages for receiving a cooling medium and flowing the cooling medium along the airfoil to cool the airfoil, a method of cooling the platform comprising the steps of:

providing a cavity within or along an underside of the platform, said cavity having inner and outer walls arranged to provide a serpentine-shaped cooling passage within said cavity;

extracting at least a portion of the cooling medium from one of said airfoil cooling passages;

flowing the extracted cooling medium portion within the platform and cooling circuit of the cavity to convectively cool the platform, and flowing spent cooling medium from said cavity through an outlet in communication with another cooling passage of the airfoil.

14. A method according to claim 13 including forming said cavity along a low pressure side of the platform.

15. A method according to claim 13 including forming said cavity along a high pressure side of said platform.

16. In a bucket having an airfoil, a root, and a platform at an interface between the airfoil and the root, said airfoil having a cooling circuit including a plurality of generally radial passages for receiving a cooling medium and flowing the cooling medium along the airfoil to cool the airfoil, a method of cooling the platform comprising the steps of:

providing a first cavity within or along an underside of the platform: and providing a second cavity within or along an underside of the platform, extracting at least a portion of the cooling medium from a second passage of said airfoil passages, flowing the extracted cooling medium portion within the second cavity of the platform cooling circuit to convectively cool the platform, and flowing spent cooling medium from said second cavity through an outlet in communication with a further passage of the airfoil cooling passages.

17. A method according to claim 16 including forming generally serpentine-shaped flow passages within the first and second cavities, respectively.

18. A method according to claim 16 including providing said first and second cavities on respective low and high pressure sides of said platform.

19. A method according to claim 16 including providing a third cavity within or along an underside of the platform, extracting at least a portion of the cooling medium from a third passage of said airfoil passages, flowing the extracted cooling medium portion within the third cavity of the platform cooling circuit to convectively cool the platform, and flowing spent cooling medium from said third cavity through an outlet in communication with a still further passage of the airfoil cooling passages.

* * * * *